US006694905B2

(12) United States Patent
Kobayashi

(10) Patent No.: US 6,694,905 B2
(45) Date of Patent: Feb. 24, 2004

(54) AUTOMATED FEEDING MECHANISM FOR SEWING MACHINE

(75) Inventor: Yukihito Kobayashi, Tokyo (JP)

(73) Assignee: Tachi-S Co., Ltd., Tokyo (JP)

( * ) Notice: Subject to any disclaimer, the term of this patent is extended or adjusted under 35 U.S.C. 154(b) by 0 days.

(21) Appl. No.: 10/412,252

(22) Filed: Apr. 14, 2003

(65) Prior Publication Data

US 2004/0011264 A1 Jan. 22, 2004

(51) Int. Cl.[7] ..... D05B 23/00; D05B 13/00
(52) U.S. Cl. ..... 112/470.27; 112/308
(58) Field of Search ..... 112/470.27, 470.28, 112/470.12, 470.13, 2.1, 470.29, 470.33, 303, 304, 306, 308, 309, 311, 475.08; 226/108, 182, 183

(56) References Cited

U.S. PATENT DOCUMENTS 4,086,860 A * 5/1978 Kosrow et al. ..... 112/153
4,503,788 A * 3/1985 Giannuzzi et al. ..... 112/470.06
4,858,539 A * 8/1989 Schumann ..... 112/21
5,544,602 A * 8/1996 Kawasaki ..... 112/470.09
5,687,662 A * 11/1997 Kawasaki ..... 112/475.08
5,732,641 A 3/1998 Kawasaki
5,988,085 A * 11/1999 Martz ..... 112/470.13

* cited by examiner

*Primary Examiner*—Ismael Izaguirre
(74) *Attorney, Agent, or Firm*—Browdy and Neimark

(57) ABSTRACT

An automated feeding mechanism for sewing machine is comprised of: a rotary support element rotatably mounted on a table in the vicinity of the sewing machine having a feed dog member; and support elements provided on one side of the rotary support element. A trim cover assembly may be attached on the rotary support element, such that the arcuate peripheral cover section thereof is supported on the support elements and also temporarily retained thereon by a clamp element. A hard synthetic resin material may be stored in that mechanism. With this feeding mechanism, upon rotation of the rotary support element, the arcuate peripheral cover section supported on the support elements and the hard synthetic resin material juxtaposed with that peripheral cover section are smoothly and precisely fed to the sewing machine and thereby sewn together.

7 Claims, 4 Drawing Sheets

AUTOMATED FEEDING MECHANISM FOR SEWING MACHINE

BACKGROUND OF THE INVENTION

1. Field of the Invention

The present invention relates to a mechanism for feeding materials to a sewing machine in an automated manner. In particular, the invention is directed to a mechanism for automatically feeding two different materials toward a sewing machine so as to assist in automated sewing of those two materials together by the sewing machine.

2. Description of Prior Art

In ordinary process for forming an automotive seat, a trim cover assembly is attached over a whole of seat frame to provide a decorative or upholstery outer surface of the seat. Generally stated, many of trim cover assemblies comprise: a central cover section adapted to cover a horizontal central seating area of a seat on which an occupant's buttocks rests; and a curved or arcuate peripheral cover section sewn with and along the curved or arcuate peripheral end portion of the central cover section, wherein such peripheral cover section is adapted to cover a vertical peripheral walls of the seat. In some cases, a recti nearly extending retainer of hard synthetic resin material is sewn to and along a free end portion of the arcuate peripheral cover section for the purpose of anchoring the trim cover assembly to a frame or wire member provided in the seat. In other words, for instance, as can be seen from the designation (B) in FIG. 7, the retainer is of a long tape shape having a hook-like engagement portion of generally "J" shaped cross-section (at B2). This retainer is sewn with and along the free end portion of the arcuate peripheral cover material (see FIG. 8), so that the hook-like engagement portion may be engaged over a frame or a wire member provided in the seat, thereby anchoring a whole of the trim cover assembly to the inside of seat.

In advance before forming such trim cover assembly, the peripheral cover section has been sewn curvilinearly with the central cover section in such a manner as to extend vertically therefrom by about a right angle, whereupon a trim cover assembly is provided, which has a generally flat central cover section and a generally arcuate peripheral cover section extending in a vertical direction from the central cover section. Thus, as understandable from FIGS. 7 and 8, a whole of the trim cover assembly with which the retainer is to be sewn assumes a three-dimensional configuration. But, this three-dimensional configuration makes it rather difficult for a worker to sew the retainer with the peripheral cover section, because the worker has to manually guide and feed the retainer and peripheral cover section to a sewing machine while holding and aligning the end of the retainer with the end of the peripheral cover section with his own hands. As a result thereof, the sewing process has been poor in efficiency and rapidity, requiring a high expertise and long experiences on the side of workers.

SUMMARY OF THE INVENTION

In view of the above-stated drawbacks, it is a primary purpose of the present invention to provide an automated feeding mechanism for a sewing machine which allows both rectilinear retainer and arcuate peripheral cover section of trim cover assembly to be smoothly fed to a sewing machine so that those two materials can be sewn together with much ease.

In order to achieve such purpose, in accordance with the present invention, there is basically provided an automated feeding mechanism in combination with a sewing machine including a feed dog member workable in one feeding direction, wherein the automated feeding mechanism is operable for automatically feeding a hard synthetic resin material and a trim cover assembly toward the sewing machine, wherein the hard synthetic resin material has a free end and the trim cover assembly comprises a central cover section including an arcuate end portion and an arcuate peripheral cover section sewn with and along the arcuate end portion, the arcuate peripheral cover section extending vertically from the central cover section and having a free end, the automated feeding mechanism comprising:

- a table on which the sewing machine is fixedly mounted;
- a rotary support means disposed in vicinity of the sewing machine, the rotary support means having a contour generally equal in shape to a contour of the trim cover assembly, thereby allowing the trim cover assembly to be attached and supported thereon, the rotary support means being rotatably mounted on the table so as to allow the arcuate peripheral cover section of the trim cover assembly to be fed toward the sewing machine along the foregoing one feeding direction associated with the feed dog member;
- a support means arranged on one side of the rotary support means such that the support means is disposed along a peripheral end of the rotary support means, the support means being adapted to support the arcuate peripheral cover section of the trim cover assembly thereon;
- a space for allowing the hard synthetic resin material to be stored therein, the space being defined at such one side of rotary support means; and
- a clamp means provided in the support means, the clamp means being adapted to temporarily retain the arcuate peripheral cover section.

Accordingly, operation of the automated feeding mechanism causes both of juxtaposed portions of the hard synthetic resin material and arcuate peripheral cover section to be automatically fed toward the sewing machine, with the free ends of hard synthetic resin material and arcuate peripheral cover section being in alignment with each other, along the feeding direction.

In one aspect of the present invention, a drive means is provided and operable such that a peripheral velocity of the rotary support means being rotated by the drive means is equal to a feeding speed of the feed dog member at which the hard synthetic resin material and arcuate peripheral cover section are fed by the feed dog member in the feeding direction.

Other various features and advantages of the present invention will become apparent from reading of the descriptions hereinafter, with reference to the annexed drawings.

DETAILED DESCRIPTION OF PREFERRED EMBODIMENT OF THE INVENTION

Referring to FIGS. 1 to 8, there is illustrated a preferred mode of automated feeding mechanism in accordance with the present invention.

Figure 1:
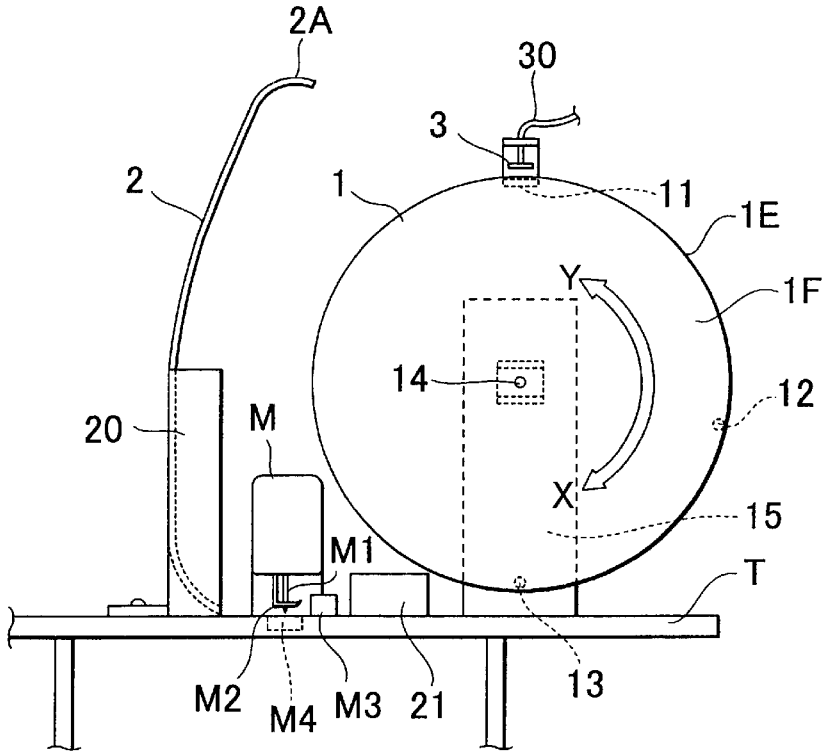
FIG. 1 is a partly broken front view showing a whole of automated feeding mechanism in accordance with the present invention and a sewing machine.
Figure 2:
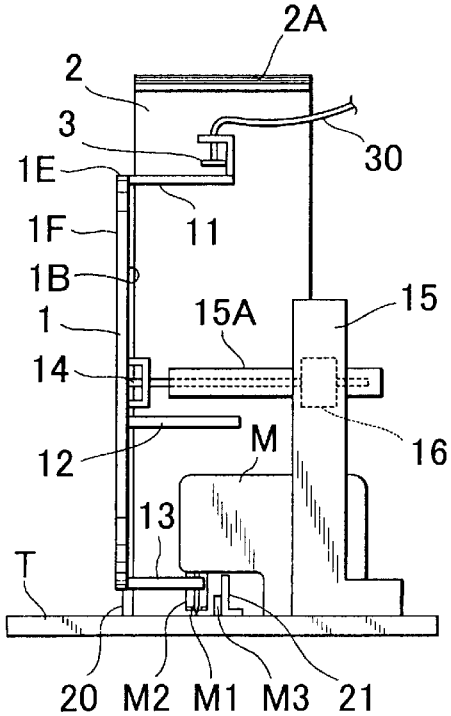
FIG. 2 is a schematic side elevational view showing the automated feeding mechanism and sewing machine.

FIGS. 1 and 2 show a basic structure of sewing machine which is provided with the automated feeding mechanism of the invention. Designation (T) denotes a table. Designation (M) denotes a conventional sewing machine mounted on the table (T), which is provided with a sewing needle (M1), a pressure foot member (M2), a feed dog member (M4), and an end alignment guide member (M3) disposed adjacent to the sewing needle (M1). Upon operation of the sewing machine (M), two juxtaposed materials are sandwiched and retained between the pressure foot member (M2) and the feed dog member (M4) and fed by the feed dog member (M4) toward the sewing needle (M1), so that the materials are fed in one feeding direction and sewn together at a predetermined sewing speed. In this respect, as seen from FIG. 2, the vertical surface of the end alignment guide member (M3) expands along a direction parallel with the sewing needle (M1), so that both free ends of the two materials are thereby guided and aligned together before being sewn by the sewing machine (M).

Figure 7:
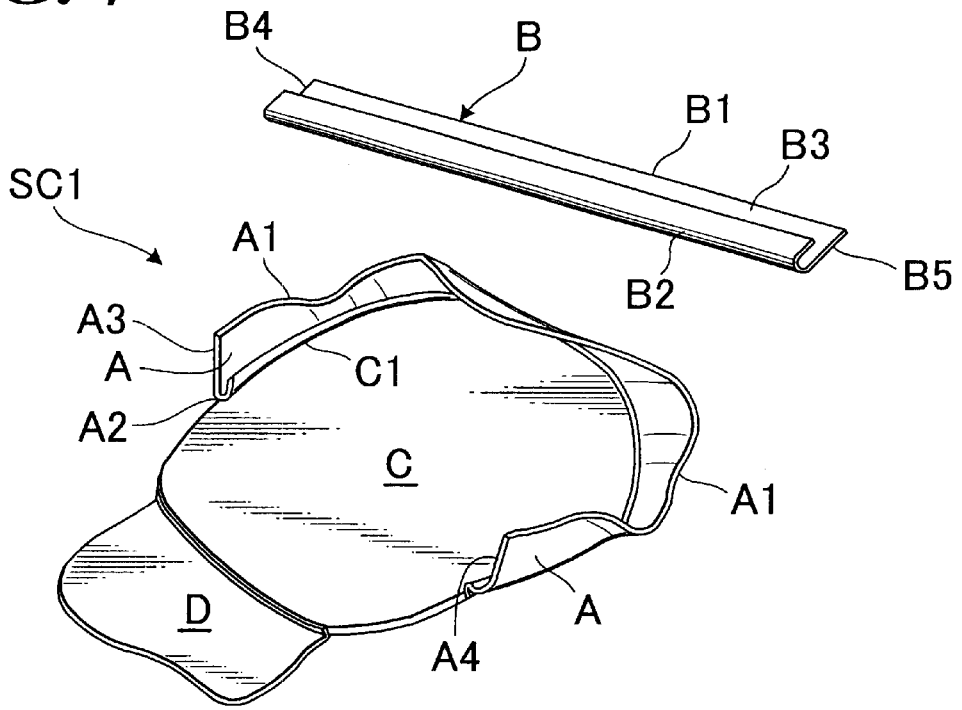
FIG. 7 is a schematic perspective view showing the retainer and the trim cover assembly which are to be set in the automated feeding mechanism.

As shown in FIG. 7, in the present embodiment, two different materials to be sewn together by the sewing machine (M) are as follows: a retainer (B) formed from a hard synthetic resin material; and a three-dimensional trim cover assembly (SC). While a brief description has been made of those two materials in the prior art description, it is noted that the retainer (B) is formed from a hard synthetic resin material having a certain elastic property such that it is of a rectilinearly extending long tape shape having a generally "J" shaped cross-section, comprising a rectilinearly extending plate portion (B3) having a free end (B1) and a hook-like engagement portion (B2) defined integrally with the plate portion (B3). It is also noted that the illustrated trim cover assembly (SC) comprises: a central cover section (C) having a curved or arcuate end portion (C1); an extension portion (D) extending outwardly from the central cover section (C); and a band of peripheral cover section sewn with and along the arcuate end portion (C1) of the central cover section (C), thus providing an arcuate peripheral cover section (A), wherein it is seen that arcuate peripheral cover section (A) extends not only curvilinearly along the arcuate end portion (C1), but also vertically therefrom, although it is in a little bit slack state as shown. Hence, a whole of the trim cover assembly (SC) assumes a substantially three-dimensional configuration. In accordance with the present invention, as will be explained, such rectilinear retainer (B) of a hard synthetic material is to be sewn with and along the curved or arcuate peripheral cover section (A) via the automated feeding mechanism of the present invention.

The illustrated mode of automated feeding mechanism is comprised of: a support plate member (1) adapted to supportively receive thereon the trim cover assembly (SC), the support plate member (1) being rotatably supported by a pedestal (15) having a motor (16) provided therein for causing rotation of the support plate member (1); a guide/support plate member (2) for guiding and supportively receiving a sewn portion being subjected to sewing by the sewing machine (M), i.e. a sewn portion of the trim cover assembly (SC) in which the peripheral cover section (A) is sewn with the retainer (B), or a final sewn product (at SC2 in FIG. 8) as will be explained later; and a pair of first and second guide members (20) (21) for guiding both central and peripheral cover sections (C) (A) and the retainer (B) along a feeding direction of the feed dog member (M4) and a sewing direction of the sewing machine (M) toward the guide/support plate member (2). As shown, the support plate member (1) and guide/support plate member (2) are so provided on the table (T) as to be disposed on the opposite sides of the sewing machine (M).

Figure 3:
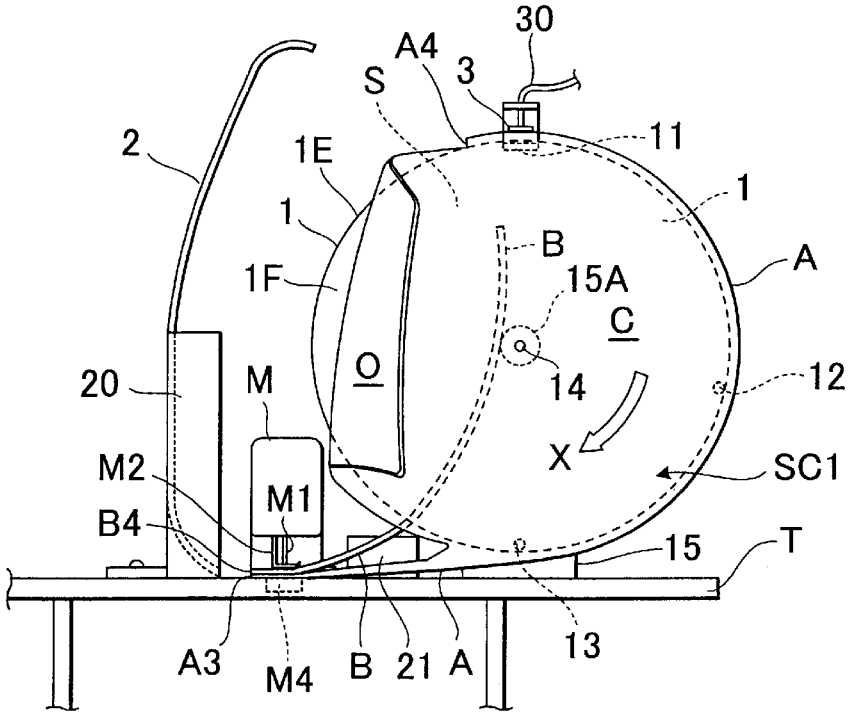
FIG. 3 is a partly broken front view showing the state where a trim cover assembly and a retainer are attached to the automated feeding mechanism.

Specifically, the illustrated support plate member (1) is of a generally circular shape having such size and diameter that allow both central and peripheral cover sections (C) (A) of trim cover assembly (SC) to be stretched and attached thereon, as seen from FIG. 3. But, this is not imitative, and the support plate member (1) may be so formed to have a proper contour generally equal in shape to a contour of the trim cover assembly (SC) or the contour of the central cover sections (C), insofar as it serves the purpose of the present invention. Further, the support plate member (1) is connected at the center thereof with the rotary shaft (14) extending horizontally from the upper portion of the vertically extending pedestal (15) fixed on the table (T). The rotary shaft (14) is rotatably supported in the cylindrical support member (15A) extending horizontally through the pedestal (15) by a right angle. As indicated in FIG. 2, the motor (16) is provided within the pedestal (15) and connected with the rotary shaft (14). Thus, operation of the motor (16) causes rotation of the support plate member (1) about the central axis of the shaft (14) in either of a normal direction (X) and a reverse direction (Y) as indicated by the corresponding two arrows (X) and (Y) in FIG. 1.

In accordance with the present invention, it is important to note that the rotational speed (or revolving number) of the motor (16) is set to an appropriate rate at which the peripheral velocity of the support plate member (1) being rotated by the motor (16) is equal to the feeding speed of the feed dog member (M4).

As shown in FIGS. 1 and 2, fixedly provided in the reverse surface (1B) of support plate member (1) and disposed along the circumferential end (1E) of the same (1) are a first support piece (11), a second support piece (12) and a third support piece (13) which are adapted for supporting thereon the curved peripheral cover section (A) vertically extending from the central cover section (C) as will be explained later. Those three pieces (11) (12) (13) project horizontally by a right angle from that reverse side (1B) and are disposed apart from one another by about a certain angle with respect to the center of rotation at (14). The first support piece (11) is provided with a clamp (3) for temporarily retaining one point of the curved peripheral section (A). While not shown clearly, the clamp (3) is so designed to be movable to and from the first support member (11). As shown, the clamp (3) is connected with a tube (30) which is in turn connected with a air pump or the like (not shown), so that, when an air is supplied by the pump through the tube (30), the clamp (3) is moved toward the first support piece (11), whereas conversely, when the air is drawn by the pump through the tube (30), the clamp (3) is moved away from the first support piece (11). The clamp (3) itself is known in the art and may be any sort of pneumatically operable clamp means or other clamp means insofar as it serves the purpose of the present invention.

Normally, as in FIG. 1, the first support piece (11) is positioned at a home point corresponding to a top of the support plate member (1) which is perpendicular with the horizontal flat surface of the table (T). The second support piece (12) is positioned at a quarter point which is generally a quarter of the circular support plate member (1) relative to the center at (14). The third support piece (13) is positioned at a lower point which is in a diametrically opposed relation with the first support piece (11) and thus situated right above and adjacent to the flat surface of table (T).

The guide/support member (2) is formed from an oblong plate having a width lager than that of the peripheral cover section (A) of trim cover assembly (SC) and a vertical length greater than the height of the support plate member (1). The width of the guide/support member (2) is such that, as viewed from FIG. 2, the left-side end of the guide/support member (2) lies substantially in alignment with the vertical line of the support plate member (1), whereas the right-side end of the guide/support member (2) lies at a point corresponding to the pedestal (16) and the backward portion of the sewing machine (M). The guide/support member (2) per se, as viewed from FIG. 1, is slightly curved along the circumferential direction of the support plate member (1) and has a downwardly curved end portion (2A). This is however not limitative, but the guide/support member (2) may be formed in any suitable manner insofar as it serves the purpose of the present invention.

As designated by (S), a space is given between the pedestal (16) and the support plate member (1), in which space (S), the retainer (B) may be stored before the present feeding mechanism is operated, as will be described.

As shown in FIGS. 1 and 2, the first guide member (20) is fixed to the right-side lateral edge of the guide/support member (2) and the table (T) so as to guide a sewn portion of the trim cover assembly (SC), in which the retainer (B) is sewn with the peripheral cover section (C), toward the guide/support member (2) and limit or prevent dislocation of that sewn portion in the transverse direction of the feeding direction in which the two materials (B) and (C) are fed by the feed dog member (M4) and sewn together by the sewing machine (M). On the other hand, the second guide member (21) is located between the sewing machine (M) and both of the support plate member (1) and pedestal (15) as seen from FIG. 1, and also located between the first guide member (20) and the pedestal (15), as seen from FIG. 2, such that the vertical flat surface of the second guide member (21) extends in a direction parallel with the sewing needle (M1).

While not shown, the sewing machine (M), the motor (16) and an air supply device for the clamp (3) are electrically connected with a computerized control unit which is programmed to control operation of each of those sewing machine (M), motor (16) and air supply device in such steps and manners as will be explained below. In particular, as stated previously, a peripheral velocity of the circular support plate member (1) is equal to a feeding speed of the feed dog member (M4), thereby insuring to feed both retainer (B) and peripheral cover section (A) smoothly and precisely without any slack therein.

Now, description will be made of how the automated feeding mechanism works in conjunction with the sewing machine (M).

At first, the trim cover assembly (SC) is fitted on the circular support plate member (1) by attaching the arcuate peripheral cover section (A) thereof on and over both circumferential end (1E) of support plate member (1) and three support pieces (11) (12) (13) so that the central cover section (C) of the trim cover assembly is stretched and placed on the outer surface (1F) of circular support plate member (1), as understandable from FIG. 3. Then, upon supply of an air through the tube (30) by turning on a corresponding switch or the like (not shown), the clamp (3) is moved to press such one end portion (A4) of the peripheral cover section (A) against the first support piece (11), thereby temporarily retaining that particular one end portion (A3) on the circumferential end (1E) of support plate member (1).

Figure 4:
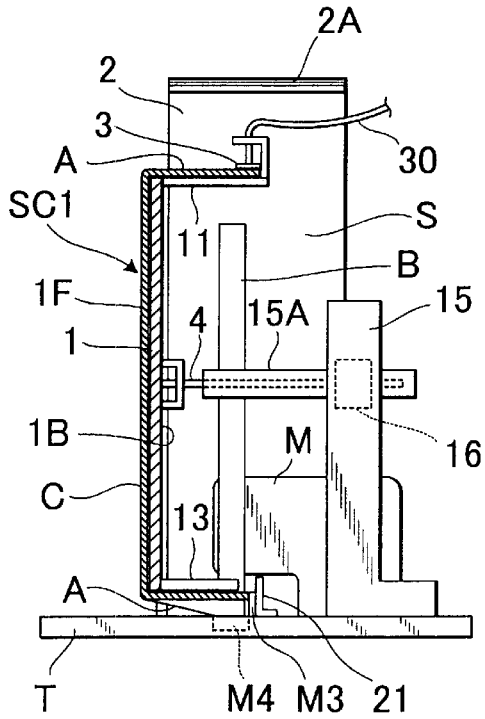
FIG. 4 is a fragmentary sectional side view showing the state where a trim cover assembly and a retainer are attached to the automated feeding mechanism.

The retainer (B) is then brought behind the reverse surface (1B) of support plate member (1), with the upper portion thereof in contact upon the horizontal support member (15A), as understandable from the phantom lines in FIG. 3 and FIG. 4, so that the retainer (B) is set and stored within the space (S) noted previously.

Next, both end portions of retainer (B) and peripheral cover section (A) are juxtaposed together before being set between the pressure foot member (M2) and the feed dog member (M4) of the sewing machine (M). Namely, both two first ends (A3) and (B4) respectively of the peripheral cover section (A) and retainer (B) are aligned with each other, while insuring that both two free ends (A1) (B1) respectively of the peripheral cover section (A) and retainer (B) are aligned with each other. The thus-juxtaposed end portions at (A3) (B4) are set between the foot member (M2) and feed dog member (M4), as shown in FIG. 3.

Upon turning on a switch (not shown), both sewing machine (M) and motor (16) are operated. The support plate member (1) is rotated in the normal clockwise direction (X) about the shaft (14), Thus, in synchronism with that rotation of support plate member (1), the juxtaposed two materials (A) (B) are fed and sewn together along a sewing line with a fixed margin from their respective free ends (A1) (B1) by the sewing machine (M) in a feeding or sewing direction toward the guide/support member (2), while being guided by the end alignment guide member (M3) and second guide member (21) precisely in that direction.

Figure 5:
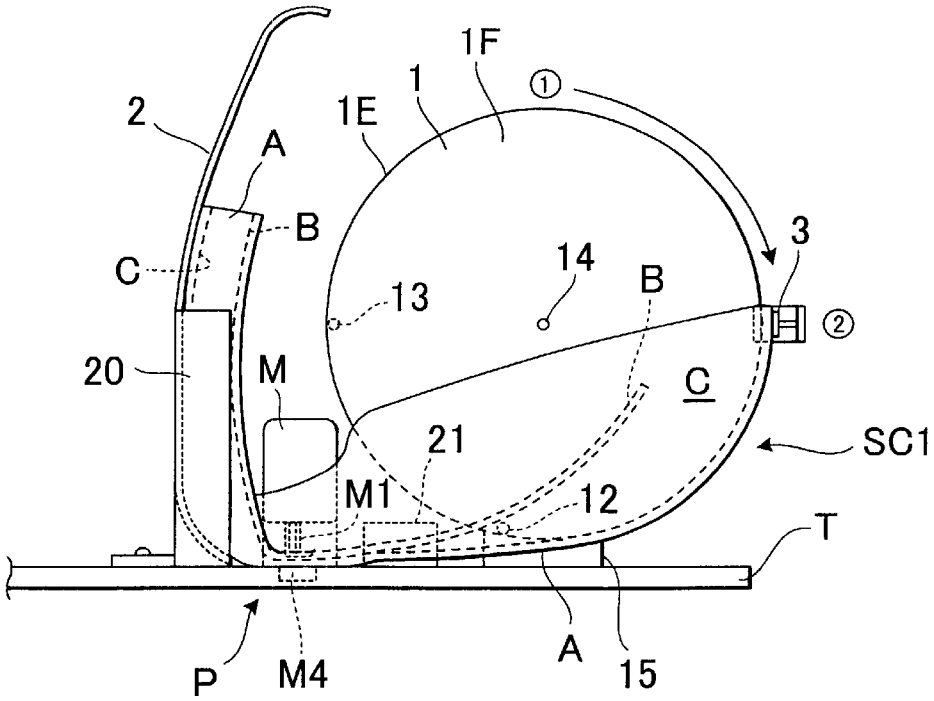
FIG. 5 is a partly broken front view which explanatorily shows the state where a sewing is performed to sew together the retainer and trim cover assembly with rotary actions of the automated feeding mechanism.

As understandable from FIG. 5, the sewn portion of the trim cover assembly (SC1), in which a certain portion of the retainer (B) and peripheral cover section (A) has been sewn together, are slidingly moved upwards on and along the vertical inward surface of the guide/support member (2) while being guided along the rectilinear sewing direction between the first and second guide members (20) (21). Therefore, the retainer (B) is sewn with and along the peripheral cover section (A) with a fixed margin given from the two free ends (B1) (A1) of the retainer (B) and cover section (A), while those particular two free ends (B1) (A1) are assuredly aligned together. But, as can be seen in FIG. 5, the sewn portion of trim cover assembly (SC1) is twisted at the point indicated by (P) on the right side of sewing machine (M) where that particular sewn portion is moved away from the sewing machine (M) and slid upwards along the guide/support member (2). As for the thus-twisted sewing portion, it is observed from FIG. 5 the central cover section (C) is contacted on the guide/support member (2) and the peripheral cover section (A) is exposed outwardly from the previous state where it has faced to the table (T).

When the support plate member (1) is rotated from the upper home position $\hat{1}$ to a quarter point $\hat{2}$ by about 45 degrees relative to the center of rotation at (14), the clamp (3) is automatically operated to release the peripheral cover section (A) therefrom under a certain programmed control, thereby allowing the remnant portion of the trim cover assembly (SC1) to be smoothly fed toward the sewing machine (M).

Figure 6:
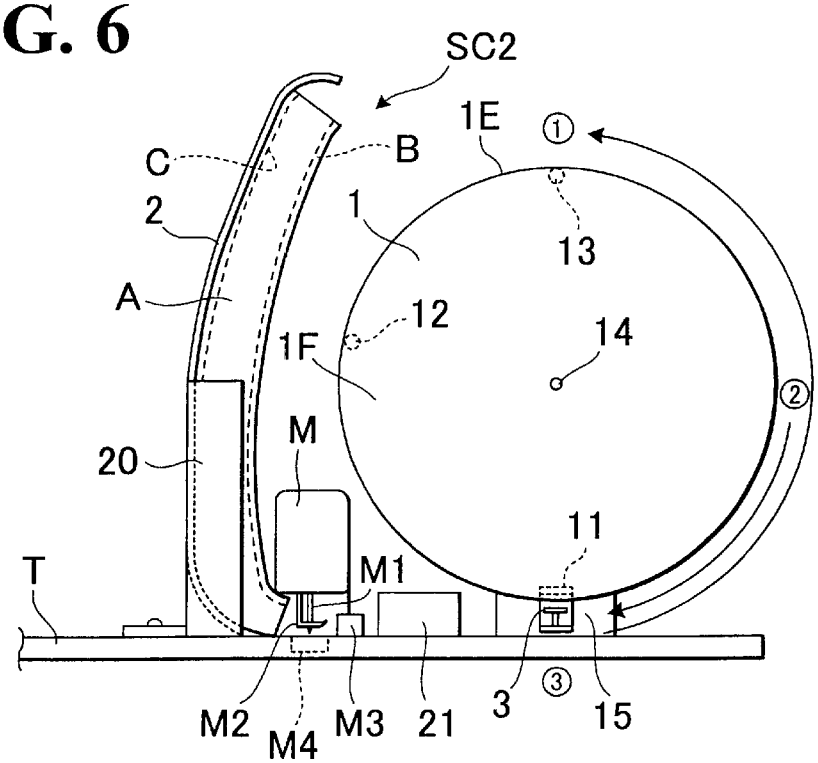
FIG. 6 is a partly broken front view which explanatorily shows the state where the sewing has been completed and also shows the rotary actions of the automated feeding mechanism.

Finally, with continued sewing operation of the sewing machine (M), the support plate member (1) is rotated by further 45 degrees from that quarter point $\hat{2}$ to the final lower point $\hat{3}$, at which the clamp (3) is positioned right above the table (T). Then, a whole of the retainer (B) is sewn with and along the arcuate peripheral cover section (A) of trim cover assembly (SC1), whereupon a final sewn product of trim cover assembly, as generally indicated by (SC2), which has the retainer (B) sewn with the peripheral cover section (A) thereof, is formed and supported on the guide/support member (2) as shown in FIG. 6. At this point, the motor (16) is automatically operated in reverse direction to rotate the support plate member (1) anticlockwise by 180 degrees from the lower point $\hat{3}$ back to the upper home point $\hat{1}$, as indicated by the arrows in FIG. 6.

Figure 8:
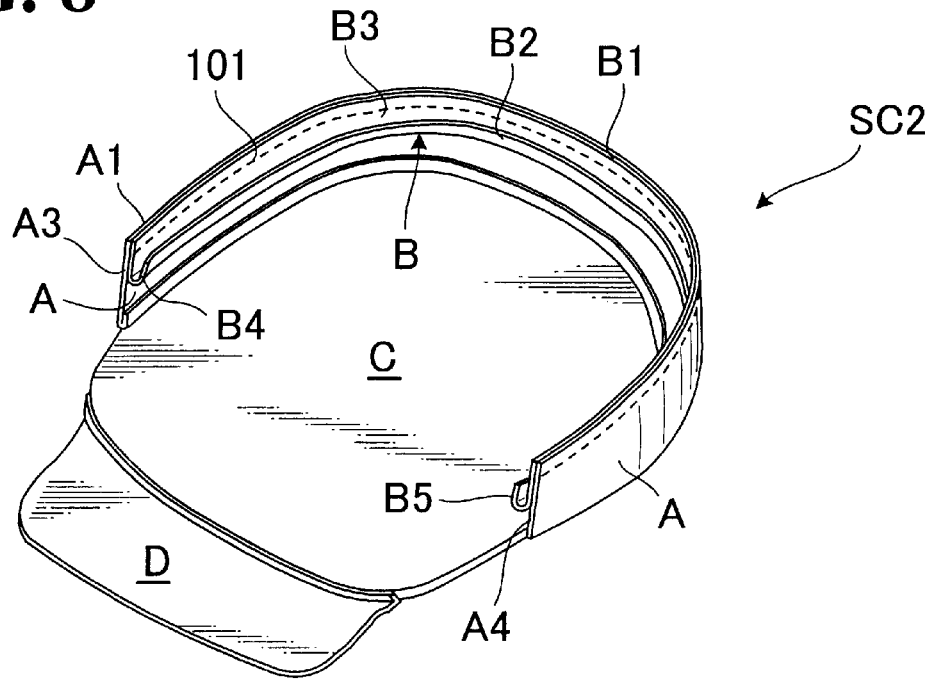
FIG. 8 is a schematic perspective view showing a final sewn product formed from the retainer and trim cover assembly by the automated feeding mechanism and sewing machine.

FIG. 8 shows the final sewn product of trim cover assembly (SC2), from which it is seen that the retainer (B) is neatly sewn with the arcuate peripheral cover section (A) as indicated by the seam (101), such that the free end (B1) of the retainer (B) is aligned with the free end (A1) of the trim cover assembly (SC1).

From the description thus far, in accordance with the present invention, it is appreciated that the following effects and advantages are attained:

(i) The curved or arcuate peripheral cover section (A) of trim cover assembly (SC1) is attached on the circumferential end of the support plate member (1) and rotated therewith toward the sewing machine (M). With this rotational feeding, the end portion (at A3) of that peripheral cover section (A) is smoothly fed toward the adjacent sewing machine (M) on and along a substantially horizontal plane in parallel with the table (T). Therefore, one end portion (at B4) of the retainer (B) stored in the space (S) is automatically and smoothly juxtaposed with such horizontally fed portion of the peripheral cover section (A), so that both rectilinear retainer (B) and arcuate peripheral cover section (A) are automatically and smoothly sewn together, with their respective free ends (B1) and (A1) being aligned with each other, without any troublesome need for a worker to manually hold and manipulate them for feeding to the sewing machine (M).

(ii) After that sewing, the sewn portion of both two materials (B) and (A and SC1), which tends to assume a generally circular shape, is smoothly guided and supported by the guide/support member (2) which extends upwardly in an arcuate manner.

(iii) The peripheral velocity of the support plate member (1) is equal to the feeding speed of the feed dog member (M4) of sewing machine (M), thereby insuring to cause both two materials (B) (A) to feed smoothly toward the sewing machine (M), without any slack and twisting occurred between the two materials.

While having described the present invention so far, it should be understood that the invention is not limited to the illustrated embodiment, but any other modification, replacement and addition may be applied thereto without departing from the scopes of the appended claims.

What is claimed is:

1. An automated feeding mechanism in combination with a sewing machine including a feed dog member workable in one feeding direction, wherein said automated feeding mechanism is operable for automatically feeding a hard synthetic resin material and a trim cover assembly toward said sewing machine, wherein said hard synthetic resin material has a free end and said trim cover assembly comprises a central cover section including an arcuate end portion and an arcuate peripheral cover section sewn with and along said arcuate end portion, said arcuate peripheral cover section extending vertically from said central cover section and having a free end, said automated feeding mechanism comprising:

a table on which said sewing machine is fixedly mounted;

a rotary support means disposed in vicinity of said sewing machine, said rotary support means having a contour generally equal in shape to a contour of said trim cover assembly, thereby allowing said trim cover assembly to be attached and supported thereon, said rotary support means being rotatably mounted on said table so as to allow said arcuate peripheral cover section of said trim cover assembly to be fed toward said sewing machine along said one feeding direction associated with said feed dog member;

a support means arranged on one side of said rotary support means such that the support means is disposed along a peripheral end of the rotary support means, said support means being adapted to support said arcuate peripheral cover section of the trim cover assembly thereon;

a space for allowing said hard synthetic resin material to be stored therein, said space being defined at said one side of said rotary support means; and a clamp means provided in said support means, said clamp means being adapted to temporarily retain said arcuate peripheral cover section, wherein, said hard synthetic resin material is juxtaposed with said arcuate peripheral cover section, with said free end of said hard synthetic resin material being aligned with said free end of the arcuate peripheral cover section, and operation of the automated feeding mechanism causes both of the thus-juxtaposed portions of said hard synthetic resin material and said arcuate peripheral cover section to be automatically fed toward said sewing machine, with said free ends of said hard synthetic resin material in alignment with each other along said feeding direction.

2. The automated feeding mechanism as claimed in claim 1, wherein a guide/support means is mounted on said table, said guide/support means being adapted to guide and support a sewn portion of said trim cover assembly in which said hard synthetic resin material and said arcuate peripheral cover section are sewn together by said sewing machine.

3. The automated feeding mechanism as claimed in claim 1, wherein said rotary support means includes a drive means for causing rotation of the rotary support means, and wherein said drive means is operated so that a peripheral velocity of said rotary support means being rotated by the drive means is equal to a feeding speed of said feed dog member at which said hard synthetic resin material and said arcuate peripheral cover section are fed by the feed dog member in said one feeding direction.

4. The automated feeding mechanism as defined in claim 1, wherein said clamp means is disposed at a first point peripherally of said rotary support means in conjunction with said support means, and wherein said rotary support means is rotated in either of a normal direction substantially corresponding to said feeding direction and a reverse direction opposite to said normal direction, to thereby cause simultaneous rotation of said clamp means and said support means by a predetermined angle in a direction to and away from said first point, with such an arrangement that, when said rotary support means is rotated to a second point away from said first point, said clamp means is automatically operated to release said part of said arcuate peripheral cover section therefrom at said second point.

5. The automated feeding mechanism as claimed in claim 1, wherein said rotary support means comprises: a generally circular support plate member having: one surface on which said central cover section of said trim cover assembly is to be contacted, said one surface corresponding to said one side of the rotary support means; and another surface opposite to said one surface; a pedestal means for supporting said generally circular support plate member, said pedestal means being fixedly mounted on said table and having a rotary shaft rotatably provided therein, said rotary shaft being connected with a center of said generally circular support plate member; and a drive means provided in said pedestal means, said drive means being connected with said rotary shaft, wherein said one surface of said generally circular support plate member expands along said feeding direction of said feed dog member associated with said sewing machine, wherein said space is defined at said another surface of said generally circular support plate member and said support means is disposed on said another surface of said generally circular support plate member, thereby allowing said hard synthetic resin material to be stored in said space, while allowing said arcuate peripheral cover section to be supported on said support means, with one part of the arcuate peripheral cover section being temporarily retained by said clamp means on the support means.

6. The automated feeding mechanism according to claim 5, wherein said drive means is operated so that a peripheral velocity of said rotary support means being rotated by the drive means relative to said center is equal to a feeding speed of said feed dog member at which said hard synthetic resin material and said arcuate peripheral cover section are fed by the feed dog member in said one feeding direction.

7. The automated feeding mechanism according to claim 5, wherein said support means comprises one support piece and at least two support pieces, wherein said one support piece is disposed at a home point corresponding to a top of said generally circular support plate member in a perpendicular relation with said table, and wherein said clamp means is provided to said one support piece, with such an arrangement that said generally circular support plate member is rotated by about 180 degrees relative to said center thereof by said drive means in either of a normal direction substantially corresponding to said feeding direction and a reverse direction opposite to said normal direction, to thereby cause simultaneous rotation of said clamp means and said one support piece by about 180 degrees from said home point to a final point right above said table, or vice versa, and that, when said one support piece is rotated from said home point to a quarter point by about 45 degrees relative to said center of said generally circular support plate member, said clamp means is operated to release said part of said arcuate peripheral cover section therefrom at said quarter point.

* * * * *